US009156139B1

(12) United States Patent
Ekhoff

(10) Patent No.: US 9,156,139 B1
(45) Date of Patent: Oct. 13, 2015

(54) DISC SPINDLE WITH FLEXIBLE CAP CLAMPING

(76) Inventor: Donald L. Ekhoff, Morgan Hill, CA (US)

( * ) Notice: Subject to any disclaimer, the term of this patent is extended or adjusted under 35 U.S.C. 154(b) by 630 days.

(21) Appl. No.: 13/495,616

(22) Filed: Jun. 13, 2012

Related U.S. Application Data

(60) Provisional application No. 61/496,358, filed on Jun. 13, 2011.

(51) Int. Cl.
*B25B 5/12* (2006.01)
*B25B 5/06* (2006.01)
*B25B 5/08* (2006.01)

(52) U.S. Cl.
CPC ..... *B25B 5/122* (2013.01); *B25B 5/061* (2013.01); *B25B 5/087* (2013.01)

(58) Field of Classification Search
USPC ..... 269/27, 30, 32
See application file for complete search history.

(56) References Cited

U.S. PATENT DOCUMENTS 4,755,981 A * 7/1988 Ekhoff ..... 720/707
5,637,200 A * 6/1997 Tsymberov ..... 204/298.15
5,757,584 A 5/1998 Schick
6,556,536 B1 4/2003 Reynolds et al.
6,836,461 B2 12/2004 Baum et al.
7,795,559 B2 9/2010 Wojcik et al.
7,958,619 B1 * 6/2011 Pletschet ..... 29/559
8,424,033 B2 * 4/2013 Smirnov et al. ..... 720/714

OTHER PUBLICATIONS

Office Action in U.S. Appl. No. 13/495,628, mailed on Feb. 26, 2013.
U.S. Appl. No. 13/495,628, filed Jun. 13, 2012, Eckhoff.
Office Action in U.S. Appl. No. 13/495,628, mailed on Feb. 26, 2013, 6 pages (pp. 1-6 in pdf).

* cited by examiner

*Primary Examiner* — Lee D Wilson
*Assistant Examiner* — Shantese McDonald
(74) *Attorney, Agent, or Firm* — Mitch Harris, Atty at Law, LLC; Andrew M. Harris

(57) ABSTRACT

A hub for holding media during manufacturing processes, such as inspection, includes a flexible cap at an end that has a cylindrical profile for engaging with the central void in the media. The cap is expanded to retain the media, avoiding contact of the clamping mechanism with the face of the media, so that particulation is reduced and contact confined to the edges of the media's central void. An actuator draws end of the cap toward the clamp body to place the cap in a clamping state and moves the end of the cap away from the clamp body to unclamp a disc. Vacuum or pressure may be used to move the actuator to the clamping or released state by providing a piston within the hub and applying vacuum to one side of a diaphragm coupled to the piston or pressure to the other.

19 Claims, 5 Drawing Sheets

DISC SPINDLE WITH FLEXIBLE CAP CLAMPING

This U.S. Patent application claims priority under 35 U.S.C. §119 to U.S. Provisional Patent Application Ser. No. 61/496,358 filed on Jun. 13, 2011.

CROSS-REFERENCE TO RELATED APPLICATIONS

The present U.S. Patent Application is related to U.S. Patent Application Ser. No. 13/495,628, entitled "DISC SPINDLE WITH INTERNAL PARTICULATE REMOVAL", filed on Jun. 13, 2012 and issued as U.S. Pat. No. 8,553,518 on Oct. 8, 2013 to the same inventor. The above-referenced U.S. Patent Application is incorporated herein by reference.

BACKGROUND OF THE INVENTION

1. Field of the Invention

The present invention relates generally to clamping devices for releaseably clamping media discs such as hard disc platters and other media, including removable optical media, to a spindle during manufacturing inspection processes.

2. Description of the Related Art

Clamping air bearing spindles are in widespread use in drive and storage media manufacturing. The media are secured and inspected by inserting a hub of the spindle through the media and activating the clamping mechanism of the hub. The clamping mechanism typically engages an outer face of the media to secure the media to the spindle, which is then rotated on the air bearing to position the media in an optical inspection path of the inspection system.

Existing spindle clamping mechanisms generate particulate due to the moving parts and contact with the optical media. The particulate can lead to data errors, and thus it is desirable to reduce the amount and impact of particulate deposition caused during the inspection process.

SUMMARY OF THE INVENTION

The above objectives and others are achieved in an air bearing spindle having a flexible cap clamp, and its method of operation.

The spindle includes a rotor and a stator. The rotor includes a clamp formed from a flexible material located at an end of the spindle. A portion of the clamp that secures media to the spindle has a cylindrical profile that expands radially to secure the media and retracts radially to release the media. The clamp is inserted through the cylindrical void in the center of the media so that the cylindrical profile of the clamp can engage with the edges of the void in the media. The expanding and releasing of the clamp can be accomplished by pressure/vacuum applied to a piston in the stator, or purely mechanical or electro-mechanical actuation may alternatively be provided in the spindle.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention encompasses disc clamping spindles for securing media discs during inspection and other manufacturing processes. Existing flexible clamp designs tend to deposit particulate on the face of the disc, since clamps such as the clamp disclosed in U.S. Pat. No. 5,025,340 draw a flexible bushing down on a face of the disc to secure the disc to a spindle. Further, such designs using materials such as rubber will shed particulate. Other designs having multiple metal components such as the ones disclosed in U.S. Pat. No. 4,755,981 to the instant inventor, have multiple surfaces that can generate particulate due to their motion and are also in general more complex to manufacture and maintain. The present invention provides low particulation and a simple design by providing a cap made from a flexible, but optionally fairly rigid engineering material having a cylindrical profile for contacting inner surfaces of the central circular aperture in the disc. The cap is compressed to expand the cap slightly, thereby applying force to the inner wall of the aperture and securing the disc.

Figure 1:
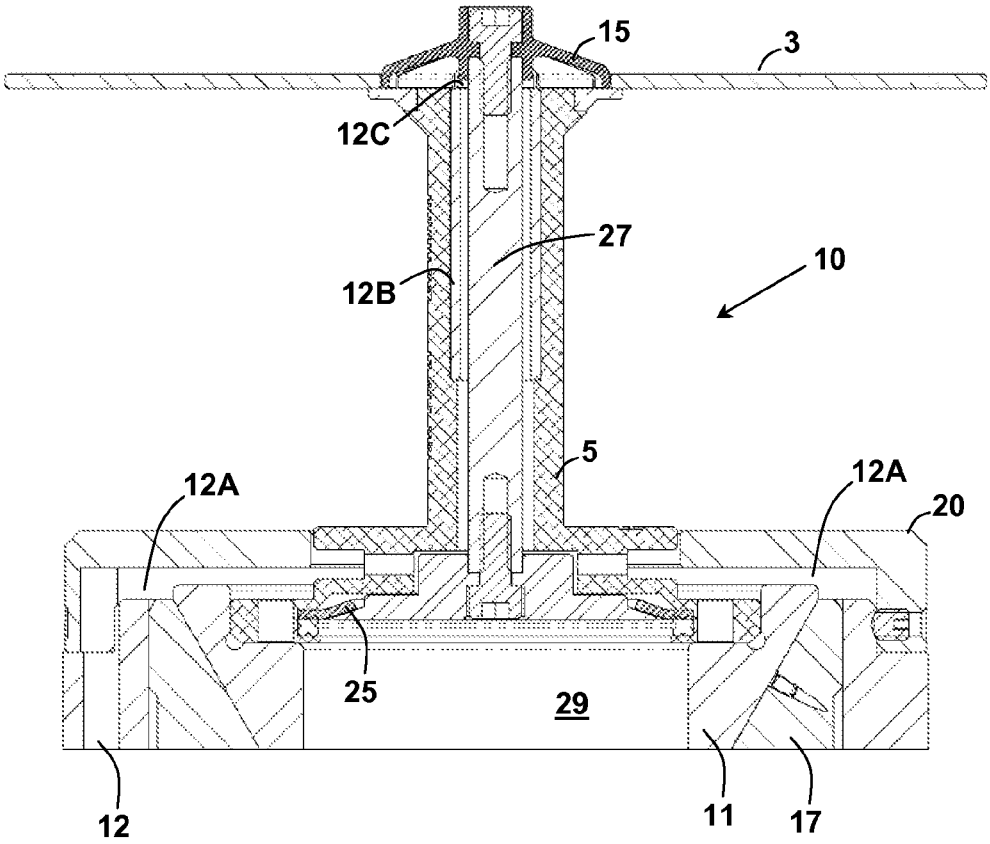
FIG. 1 is a cross-section view of a disc spindle in accordance with an embodiment of the present invention.

Referring now to FIG. 1, an air bearing spindle 10 for rotating a media disc 3 during inspection and other manufacturing processes is shown, in accordance with an embodiment of the present invention. Spindle 10, as depicted, includes particulate removal features, such as shroud 20, described in further detail in the above-incorporated U.S. Patent Application, which may be used in conjunction with the clamping features of the present invention, but which alternatively may be omitted in accordance with other embodiments of the present invention. The clamping techniques of the present invention do not require inclusion of particulate removal features disclosed and claimed in the above-incorporated U.S. Patent Application, but performance can be improved by combining the mechanisms of the present invention with those disclosed in the above-incorporated U.S. Patent Application. Spindle 10 includes a rotary bearing formed by a rotor 11, that turns to rotate a clamp body 5 that includes a disc clamping cap 15 for retaining media disc 3 at an end of spindle 10. Rotor 11 sits in a stator 17 formed by a body of spindle 10 and is floated above stator 17 by a continuous introduction of pressurized air or other gaseous mixture or element, so that an extremely low friction air bearing is formed for rotation of clamp body 5. Void 12A communicates with a channel 12 that couples to a vacuum port when spindle 10 is mounted to remove the air provided to float rotor 11 above stator 17, along with any particulate that might otherwise accumulate in spindle 10. Void 12A further communicates with axial grooves 12B in clamp body 5 that communicate vacuum to further channels 12C to remove particulate generated in the vicinity of disc clamping cap 15.

Disc clamping cap 15 is formed from a rigid plastic material such as polyether ether ketone (PEEK) or other suitable material compatible with a clean room environment that will not generate substantial particulate due to mechanical wear over many cycles of use. Alternatively, disc clamping cap 15 may be formed from metal such as heat-treated steel for durability. Disc clamping cap 15 is placed in a clamping state by retracting shaft 27, which in the depicted embodiment is performed by applying a vacuum to the base of rotor 11 at chamber 29 which communicates with a bottom side of a flexible diaphragm 25 mechanically coupled to shaft 27. In accordance with alternative embodiments of the invention, shaft 27 can be replaced with another form of actuator that provides for movement of disc clamping cap 15 when flexible diaphragm is moved. Part of chamber 29 may be filled with material to reduce the volume of air that must be removed to move shaft 27 to activate disc clamping cap 15. As will be illustrated in detail below with reference to FIG. 3B, in accordance with another embodiment of the invention, disk clamping cap 15 can alternatively be activated by pressure by including a spring above flexible diaphragm 25 to retain disc clamping cap 15 in the clamped position, and applying pressure in chamber 29 to release disc clamping cap 15. Disc clamping cap 15 has a diameter smaller than the minimum tolerance size of the specified aperture for the particular disc media being handled.

Figure 2A:
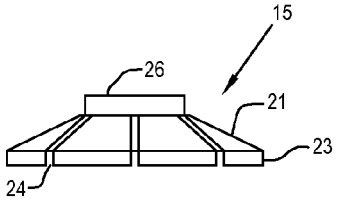
FIG. 2A is a side view and FIG. 2B is a top view showing details of flexible cap 15 of FIG. 1 in accordance with an embodiment of the present invention.
Figure 2C:
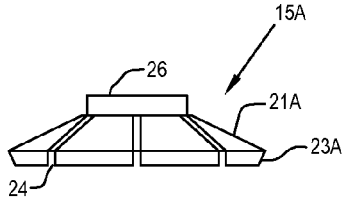
FIG. 2C is a side view showing details of a flexible cap 15A in accordance with an alternative embodiment of the present invention.
Figure 2B:
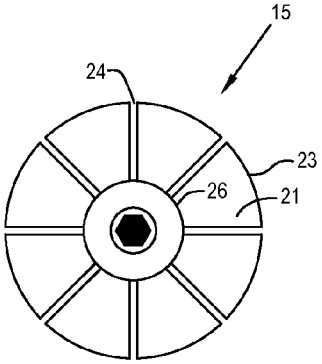

Referring now to FIG. 2A and FIG. 2B, details of disc clamping cap 15 are shown in accordance with an embodiment of the present invention. Disk clamping cap 15, as mentioned above, is formed from a flexible material that expands radially when a hub 26 portion of disc clamping cap 15 is drawn downward toward the spindle body, in order to apply force to the inside annular face of the central aperture in the media being handled. Slits 24 are formed through cap 15 and generally extend through cap 15 except in a region around hub 26, which improves the flexibility of cap 15. Disc clamping cap 15, as depicted in accordance with an embodiment of the invention, has a conical profile over a portion 21 of disc clamping cap 25 extending from an end away from spindle (distal end) to a second profile portion that has a substantially constant diameter, and thus forms a cylindrically-profiled portion 23. It is the cylindrical-profiled portion that makes contact with the inner face (inside diameter) of the aperture through media disc 3, and thus, in the depicted embodiment, disc clamping cap 15 does not require contact with, nor does disc clamping cap 15 substantially contact the outer face of media disc 3, when placed in the clamping state.

Figure 2D:
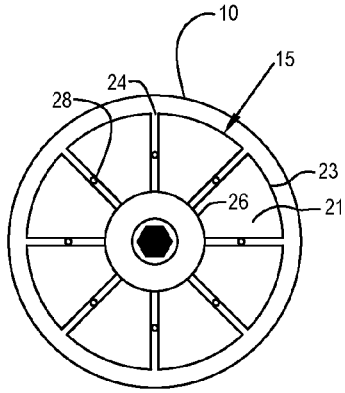
FIG. 2D is a top view showing details of flexible cap 15 and including posts 28 in accordance with another embodiment of the present invention.

Referring now to FIG. 2C, a disc clamping cap 15A in accordance with another embodiment of the invention is shown. Rather than provide a second cylindrical profile portion as in disc clamping cap 15 of FIG. 2A, disc clamping cap 15A has a tapered edge 23A that is especially useful when media must be mounted when the spindle is in a horizontal orientation. Tapered edge 23A prevents the media from sliding off of the spindle before clamp 15A is activated. Referring now to FIG. 2D, yet another variation of disc clamping cap 15 and spindle 10 are shown in accordance with another embodiment of the invention. In the depicted embodiment, pins 28 are added to the top face of spindle under flexible cap 15 in order to prevent rotation of flexible cap 15, but still permit flexible cap to expand and contract radially by locating pins 28 within slits 24. Preventing rotation of flexible cap 15 aids in registration and mounting of media to spindle 10.

Figure 3A:
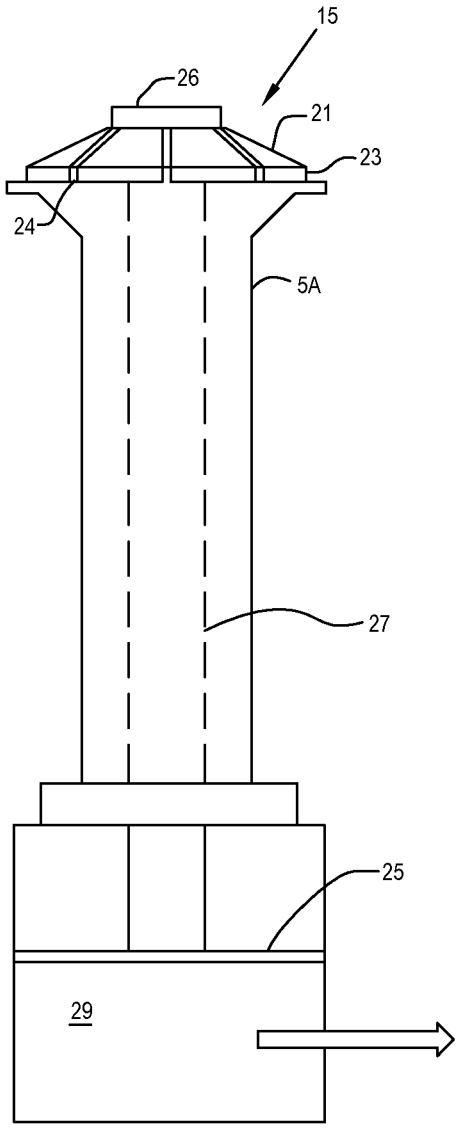
FIG. 3A is a simplified pictorial diagram illustrating operation and structure of a clamp within a spindle in accordance with an embodiment of the present invention.

Referring now to FIG. 3A, a spindle in accordance with an embodiment of the invention is shown. A clamp body 5A includes at a distal end, disc clamping cap 15, which is activated by vacuum applied to void 29 in a manner similar to that of spindle 10 in FIG. 1 as described above. The vacuum is communicated to the bottom side of diaphragm 25. The movement of diaphragm 25 lowers shaft 27, which, in turn compresses disc clamping cap 15 by drawing hub 26 downward, causing a media disc placed on disc clamping cap 15 to be secured in place. The leverage provided by the above-described mechanism is quite great, as small movement of actuator 27 can produce a substantial force from only slight changes in the diameter of disc clamping cap 15. The combination of features provided in the design described above make it possible to retain the media discs with a vacuum on the order of 0.80 atmosphere.

While vacuum provides a convenient method of operation that is consistent with the additional particulate removal techniques in the above-incorporated U.S. Patent Application, pressure activation can also be implemented in accordance with other embodiments of the present invention. In particular, when used in combination with techniques described in the above-incorporated U.S. Patent Application, any particulate that is introduced through the pressure source will be removed before it can be emitted from the hub.

Figure 3B:
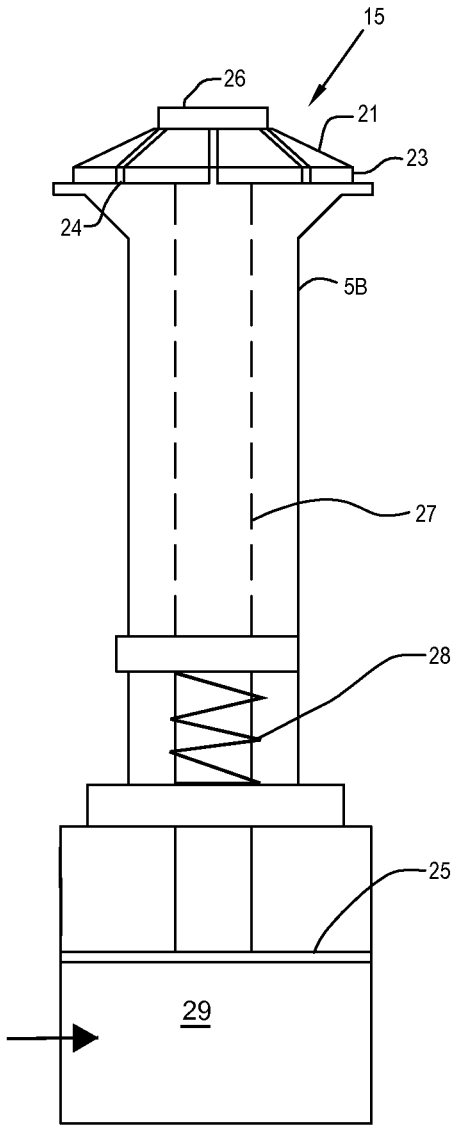
FIG. 3B is a simplified pictorial diagram illustrating operation and structure of a clamp within a spindle in accordance with another embodiment of the present invention.

Referring now to FIG. 3B, a spindle in accordance with another embodiment of the invention is shown. A clamp body 5B includes at a distal end, disc clamping cap 15, which is activated to the clamped state by a spring 28 mechanically coupled to shaft 27, and is placed in the released state by applying a pressure to chamber 29 below diaphragm 25. The movement of diaphragm 25 by spring 28 lowers shaft 27, which, in turn, applies force to disc clamping cap 15 to secure the media.

While the terms top and bottom, beneath and above, etc. are used to describe the embodiments depicted in FIGS. 1-4, the terms and orientations used are merely for convenience, and it is understood that the spindle and hubs described above may be used and operated in any orientation and may be moved through different orientations in order to capture and position media discs for inspection and other manufacturing processes.

Figure 4:
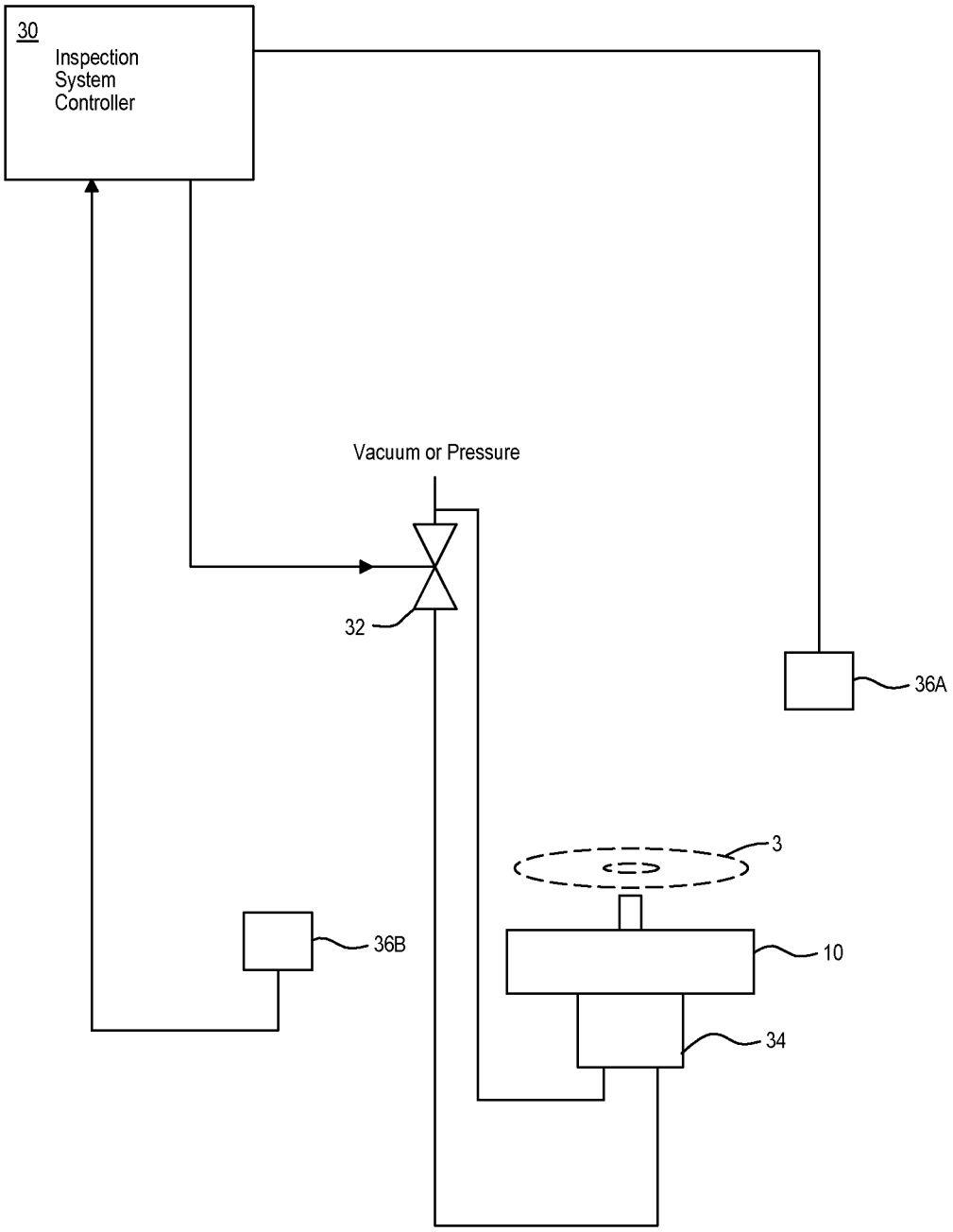
FIG. 4 is a block diagram of a system incorporating a spindle in accordance with an embodiment of the present invention.

Referring now to FIG. 4, a block diagram of a system in which a disc spindle 10 in accordance with an embodiment of the present invention is incorporated. An inspection system controller 30 provides control of a motor 34 that rotates spindle 10, to rotate media disc 3 in front of optical inspection heads 36A and 36B that are also interfaced to inspection system controller 30. Vacuum or pressure is applied to spindle 10 via a vacuum source and a valve 32 controlled by inspection system controller 30, controls the clamping and unclamping of media disc 3. Air (or other gas/fluid) pressure or vacuum applied to the stator within spindle 10 is continuously supplied to float the air bearing of spindle 10, and optionally so that any particulate introduced from the pressure supply can be removed by the in accordance with the techniques described in the above-incorporated U.S. Patent Application.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A spindle clamp for securing a media disc, comprising: a clamp body; and a cap formed from a flexible material affixed to an end of the clamp body for accepting the media disc by insertion of a circular aperture in the center of the media disc over the cap, wherein the cap has a clamped and an unclamped state, wherein when the cap is in the clamped state a first portion of the cap is expanded in cross-section to apply force around the inside face of the circular aperture to secure the media disc to the spindle without substantially contacting an outer face of the media disc, and wherein when the cap is in the unclamped state, the cap applies substantially no force to the inside edge of the circular aperture, wherein the cap has a conical profile that increases from a diameter less than that of a cylinder-shaped profile of a first portion of the cap and extending along a second portion of the length of the cap from an outer end of the cap up the first portion, whereby the circular aperture of the media disk is aligned during insertion of the cap to center the media disc on the cap.

2. The spindle clamp of claim 1, wherein the flexible material is a process-approved plastic material, whereby particulate generation due to attachment and clamping of the media disc is reduced.

3. The spindle clamp of claim 1, wherein the cap defines radial slits to enhance the flexibility of the cap.

4. The spindle clamp of claim 3, further comprising pins mounted on the cap body and disposed within the slits to prevent rotation of the cap.

5. The spindle clamp of claim 1, further comprising an actuator extending through the clamp body to the cap, wherein the actuator is coupled to the cap to compress the first portion of cap in the direction of the clamp body to place the cap in the clamped state.

6. The spindle clamp of claim 5, wherein the actuator is mechanically coupled to a gas-operated piston for moving the actuator to compress and release the first portion of the cap.

7. The spindle clamp of claim 6, wherein the gas-operated piston is operated by vacuum to place the cap in the clamped state.

8. The spindle clamp of claim 6, further comprising a spring for retaining the actuator at a position that draws the cap toward the clamp body to place the cap in the clamped state, and wherein the gas-operated piston is operated by pressure to place the cap in the released state.

9. The spindle clamp of claim 1, wherein an edge of the cap that contacts the media disc has a taper decreasing in diameter in the direction of the clamp body, whereby the media disc can be placed on the edge of the cap and retained by the taper in the unclamped state.

10. A method for securing and rotating a media disc, comprising:

locating the media disc on a hub by inserting a circular aperture in the center of the media disc over an end of a cap formed from a flexible material that is affixed to an end of the hub;

securing the media disc by expanding a profile of the cap that extends along at least a first portion of the cap in a direction of a central axis of the hub;

rotating the media disc by rotating the hub; and releasing the media disc from the hub by contracting a cylinder-shaped profile of the first portion of the cap, wherein the cap has a conical profile that increases from a diameter less than that of the cylinder-shaped profile and extending along a second portion of the length of the cap from an outer end of the cap up to the first portion, whereby the locating aligns the circular aperture of the media disk during insertion of the cap to center the media disc on the cap.

11. The method of claim 10, wherein the flexible material is a process-approved plastic material, whereby particulate generation due to the securing is reduced.

12. The method of claim 10, wherein the cap defines radial slits to enhance the flexibility of the cap for performing the securing.

13. The method of claim 10, wherein the securing and releasing comprise compressing and releasing the first portion of the cap in the direction of the hub by moving an actuator extending through the hub to the cap, wherein the actuator is mechanically coupled to the cap.

14. The method of claim 13, wherein the moving is performed by activating a gas-operated piston mechanically coupled to the actuator.

15. The method of claim 14, wherein the gas-operated piston is operated by vacuum to perform the contracting.

16. The method of claim 14, wherein the securing comprises applying force to the gas-operated piston with a spring to perform the contracting, and wherein the releasing comprises applying pressure to the piston to return the actuator to a position that pushes the piston away from the hub.

17. A spindle clamp for securing a media disc, comprising: a clamp body;

a cap formed from a flexible material affixed to an end of the clamp body for accepting the media disc by insertion of a circular aperture in the center of the media disc over the cap, wherein the cap has a conical profile extending from an outer end to a first axial position and expanding in diameter toward the first axial position, and wherein the cap has an edge profile extending from the first axial position to end of the clamp body, wherein the cap defines radial slits to enhance flexibility of the cap;

an actuator extending through the clamp body to the cap, wherein the actuator is coupled to the cap to compress a portion of the cap in the direction of the clamp body to place the cap in the clamped state; and a gas-operated piston mechanically coupled to the actuator for moving the actuator to compress and release the cap.

18. The spindle clamp of claim 17, wherein the gas-operated piston is operated by vacuum to place the cap in the clamped state.

19. A spindle clamp for securing a media disc, comprising: a clamp body; and a cap formed from a flexible material affixed to an end of the clamp body for accepting the media disc by insertion of a circular aperture in the center of the media disc over the cap, wherein the cap has a clamped and an unclamped state, wherein when the cap is in the clamped state a first portion of the cap is expanded in cross-section to apply force around the inside face of the circular aperture to secure the media disc to the spindle without substantially contacting an outer face of the media disc, and wherein when the cap is in the unclamped state, the cap applies substantially no force to the inside edge of the circular aperture, wherein an edge of the cap that contacts the media disc has a taper decreasing in diameter in the direction of the clamp body, whereby the media disc can be placed on the edge of the cap and retained by the taper in the unclamped state.

* * * * *